United States Patent [19]

Jezuit et al.

[11] 4,268,973

[45] May 26, 1981

[54] SILVERWARE DRYER

[75] Inventors: Arthur D. Jezuit, Wood Dale; Edwin J. Geu, Norridge, both of Ill.

[73] Assignee: Hooper, Inc., Elmhurst, Ill.

[21] Appl. No.: 78,571

[22] Filed: Sep. 24, 1979

[51] Int. Cl.[3] ..... F26B 11/18

[52] U.S. Cl. ..... 34/69; 34/164; 34/185; 34/187; 211/69.8; 248/624

[58] Field of Search ..... 248/624; 211/69.1, 69.5, 211/69.8; 34/60, 69, 164, 185, 187, 195, 197; 134/158, 161

[56] References Cited

U.S. PATENT DOCUMENTS

| | | | |
|---|---|---|---|
| 982,795 | 1/1911 | Cochran | 211/69.8 |
| 1,345,059 | 6/1920 | Belknap . | |
| 1,460,400 | 7/1923 | Belknap . | |
| 1,540,793 | 6/1925 | Maloney . | |
| 1,567,992 | 12/1925 | Dyktor et al. | |
| 3,240,216 | 3/1966 | Sadwith . | |
| 3,294,273 | 12/1966 | Ettlinger . | |
| 3,529,742 | 9/1970 | Cumming . | |
| 3,779,258 | 12/1973 | Brenner et al. | |
| 3,847,274 | 11/1974 | Inglish . | |
| 3,908,681 | 9/1975 | Schimke et al. | 34/195 |
| 4,053,993 | 10/1977 | Schregenberger | 34/233 |

*Primary Examiner*—Larry I. Schwartz

*Attorney, Agent, or Firm*—Wegner, Stellman, McCord, Wiles & Wood

[57] ABSTRACT

A silverware dryer having a casing with ducts and nozzles for directing air to a drying chamber, a portable basket usable in a washing operation and thereafter positionable in said drying chamber and with the basket having a series of vibratory holders for silverware which are also mounted for rotational movement and motor-driven members for rotating and vibrating said holders.

16 Claims, 6 Drawing Figures

35
36
24
23
37
38
D
33
21
22
34
40
41
51
50
66
65
2.
2.
52
25
85
85
98
91
99
96
97
20
90
89
46
45
32
31
30
11
10
14
15

SILVERWARE DRYER

BACKGROUND OF THE INVENTION

This invention pertains to a dryer for utensils, such as silverware and the like, wherein rapid, thorough drying of the silverware is achieved through positive cyclical agitation of the silverware while high velocity air is directed thereagainst.

The use of air for drying of silverware is known. A dishwasher of the home appliance type usually has an interval after washing is completed wherein a blower will direct air through the washing chamber to accomplish drying. For commercial use, it is also known to have dryers which direct air against utensils, such as silverware, for drying thereof. The results are not uniformly good because of retention of drops of detergent-containing water on the utensils which, because of lack of agitation during drying of the utensils, may result in drying with a detergent spot which is visible. Additionally, the drying cycle needs to be longer than necessary to obtain complete drying and evaporation of water drops or, alternatively, the utensils are not completely dry at the end of the drying cycle.

SUMMARY OF THE INVENTION

A primary feature of the invention disclosed herein is to provide a dryer for utensils, such as silverware, which performs fast, complete drying, without spotting of the silverware.

More particularly, the dryer has a drying chamber in which a portable basket can be placed and with the basket having one or more holders for silverware, with the silverware held in inclined, spread-out position during drying and with positive means for vibrating and agitating the silverware during the drying cycle to change the orientation thereof and facilitate removal of all water therefrom.

In carrying out the foregoing, the silverware dryer has a casing with a drying chamber of a size to receive a basket which is also used in the preceding washing cycle and, thereafter, transferred into the drying chamber with the basket having a plurality of holders, each having a base and a silverware-retaining section spaced therefrom, with a flexible connection therebetween and with the silverware held in inclined positions in the silverware-retaining section. Motor-driven means cyclically engageable with the holders causes elevation and sudden lowering thereof to result in vibration and also causes rotation of the holders to change the orientation thereof relative to air-circulating means including air-directing nozzles extending into the drying chamber.

More specifically, the basket mounts a series of upstanding pins, with each of the holders having a base mounted centrally on a pin for retention in the basket as well as elevation and rotation relative thereto and with a thimble, in the form of a perforated cylindrical member carrying the silverware and positionable within a holder by downward insertion therein and having a movable cup supporting the underside of the silverware whereby the pins upstanding from the basket enter through openings in the bottoms of the thimbles and engage the underside of the movable cups for elevation of the silverware into the silverware-retaining section of the holders.

The motor-driven means includes a pair of rotatable cams which are also bodily rotated in an arc underneath the holders and cyclically engage with one of a series of teeth projecting downwardly from the underside of a pair of holder bases whereby a cam will elevate and rotate a holder and thereafter permit the holder to fall and thus induce vibration of the holder and silverware to change the orientation thereof and also act to remove water therefrom.

Other objects of the invention will be apparent from the description given hereinafter, with the silverware dryer providing an improved, economical structure for rapid, thorough drying of silverware.

DESCRIPTION OF THE PREFERRED EMBODIMENT

Figure 1:
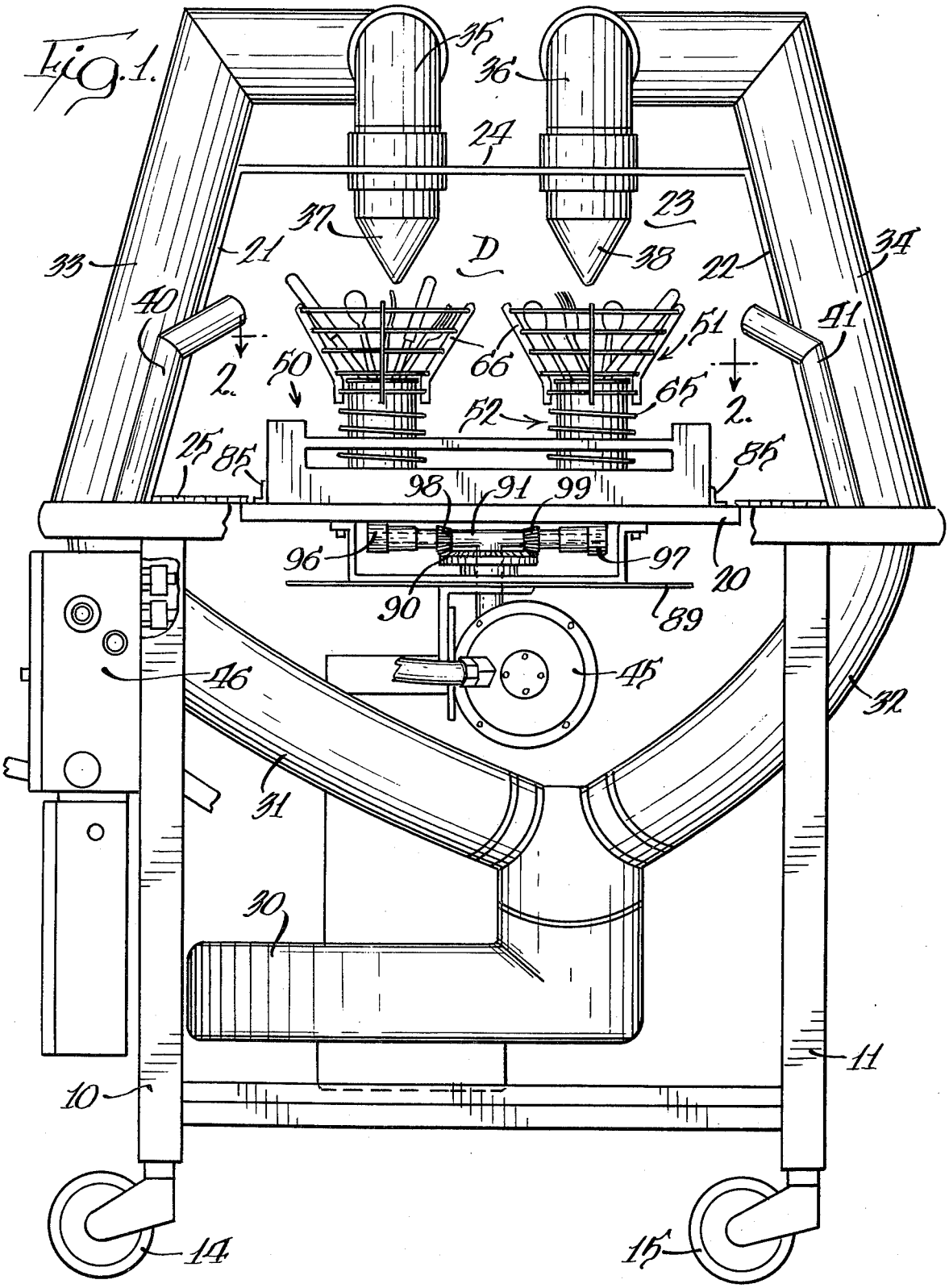
FIG. 1 is an end elevational view of the silverware dryer with end plates removed to disclose the interior structure of the dryer.

The silverware dryer is shown generally in FIG. 1 wherein a base has four corner posts, two of which are shown at 10 and 11 and each of which has a caster permitting movement of the dryer and with casters 14 and 15 shown in association with posts 10 and 11. The posts mount a platform 20 at the upper ends thereof forming the base of a drying chamber, indicated generally at D. The drying chamber D is enclosed by a cover having four upwardly and inwardly inclined side walls, three of which are shown at 21, 22 and 23 and with a side wall opposite side wall 23 being omitted in FIG. 1 to permit viewing structure disposed interiorly of the drying chamber. Additionally, there is a top wall 24. The cover is hinged along one edge, as indicated at 25, whereby the cover may be pivoted to a position away from overlying relation with the platform 20 to permit access to the drying chamber D.

Means are provided for directing high velocity air to the drying chamber D, including a motor-driven blower 30 having its outlet connected to a pair of ducts 31 and 32 which receive high velocity air from the blower and direct it to a pair of separable, but interconnected ducts 33 and 34 which, at their upper ends, branch into a pair of ducts with one duct of each pair being shown at 35 and 36 in FIG. 1 and which extend through the top wall 24 of the cover and terminate in air-directing nozzles 37 and 38. The ducts 33 and 34 are separable whereby they may move with the cover as it is pivoted to an open position for access to the drying chamber D. With the two pairs of ducts extending into the drying chamber, there are a total of four nozzles directed downwardly and generally overlying four holders for silverware which are to be described. Additionally, branch ducts, such as ducts 40 and 41, are supplied with air from the ducts 31 and 32 and extend inwardly through the side walls of the cover to direct high velocity air through nozzles toward the silverware from the sides of the drying chamber.

The dryer additionally includes a drive motor 45 supported within the cabinet of the dryer beneath the platform 20 and which is used for rotating a drive shaft to be described subsequently. Completing the over-all construction of the dryer is a control cabinet 46 which has connections to an electrical power source and switch controls including switches for the blower 30 and motor 45 as well as safety interlock circuitry for disabling the dryer when the cover is pivoted to an open position to provide access to the drying chamber D.

Figure 4:
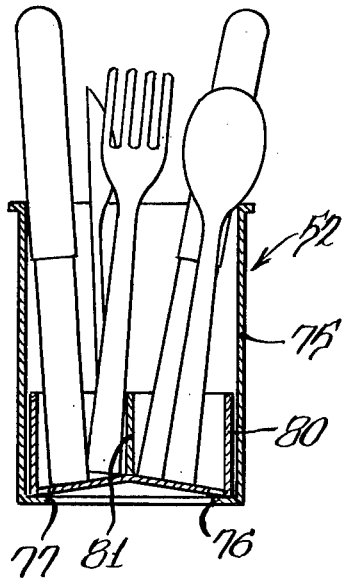
FIG. 4 is a vertical section of a thimble for holding silverware.
Figure 5:
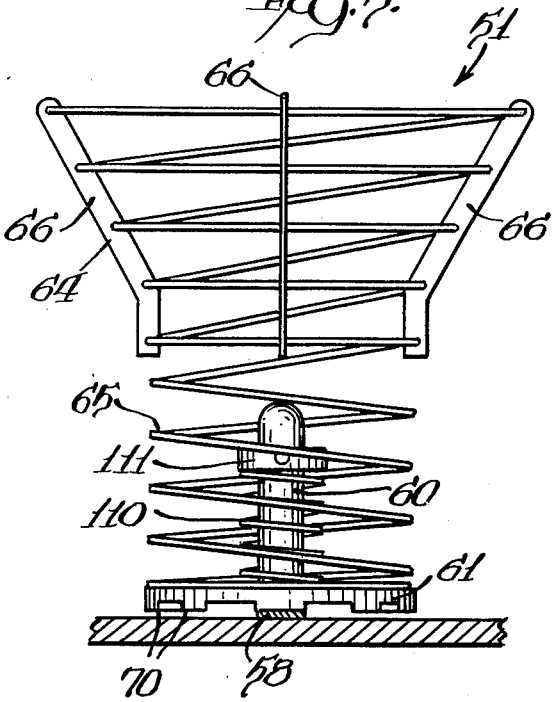
FIG. 5 is a vertical section, taken generally along the line 5—5 in FIG. 2.

The structure for handling the utensils, such as silverware, includes a portable basket, indicated generally at 50; a vibratory holder, indicated generally at 51; and a thimble, indicated generally at 52 and shown in cross section in FIG. 4.

Figure 2:
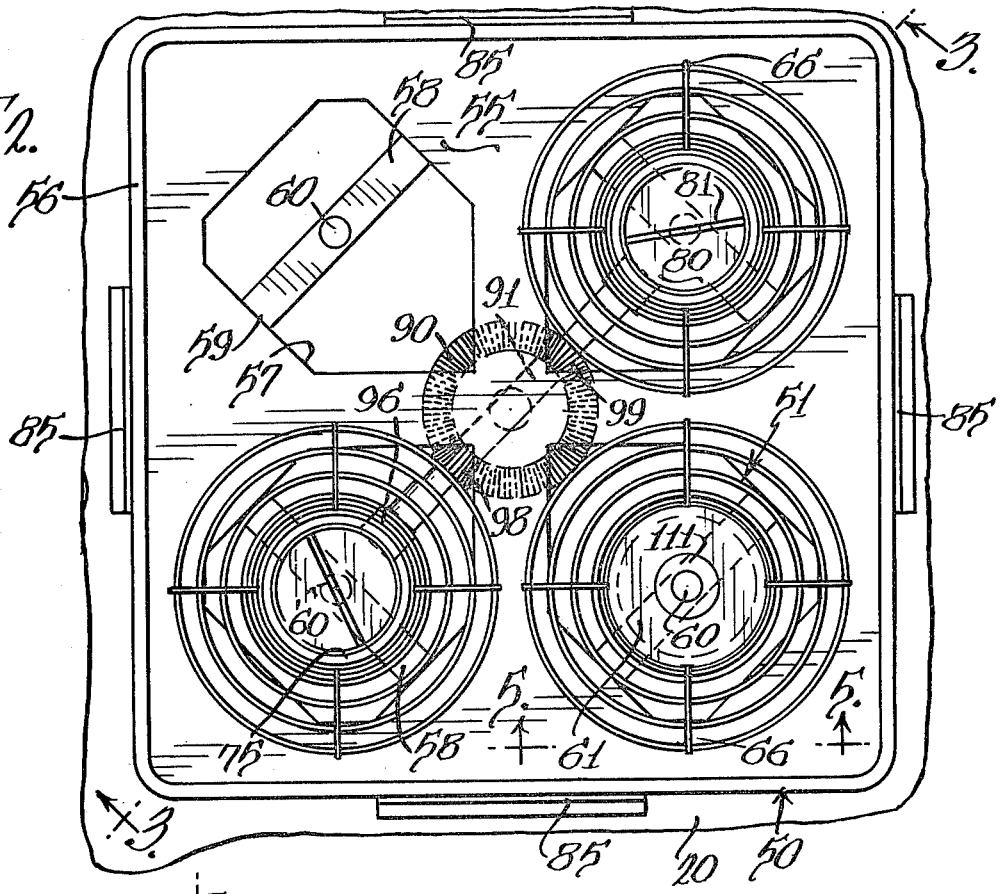
FIG. 2 is a plan section, on an enlarged scale, taken generally along the line 2—2 in FIG. 1 and with parts removed.
Figure 3:
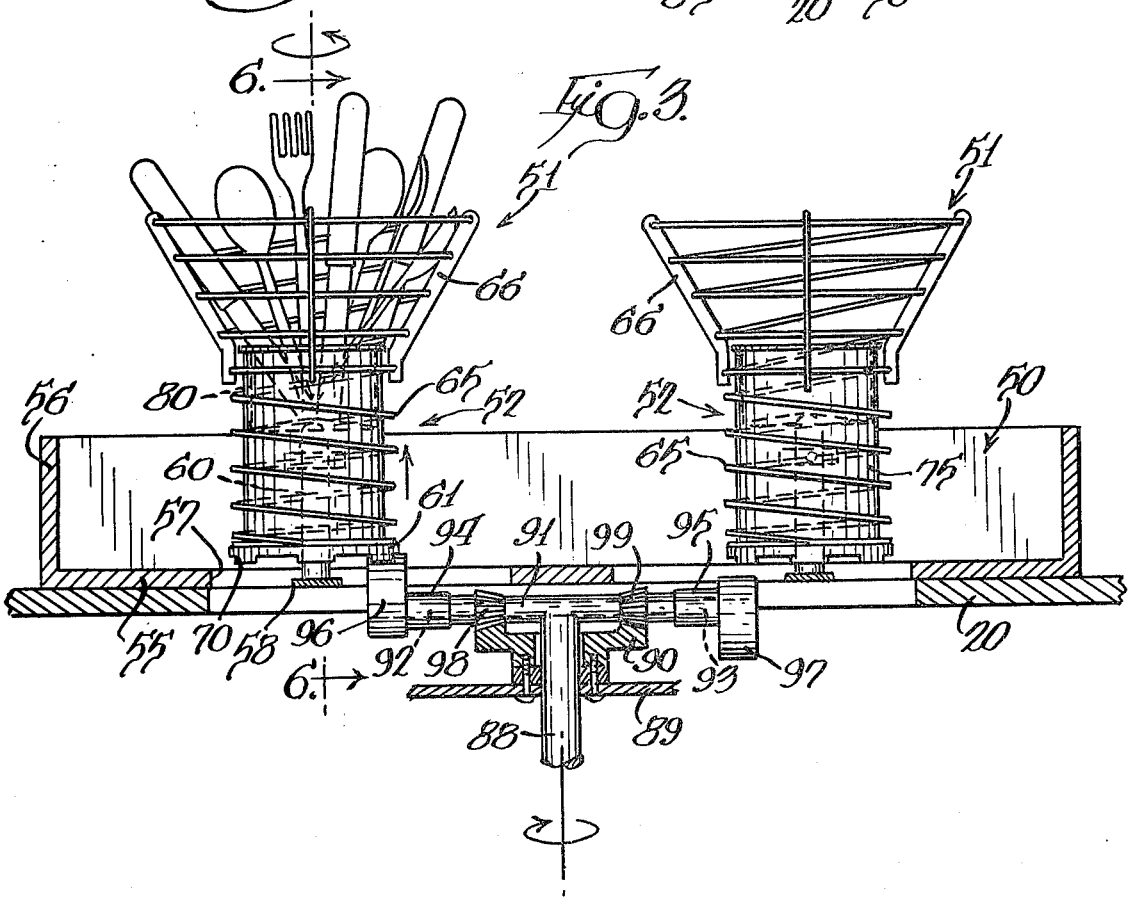
FIG. 3 is a vertical section, taken generally along the line 3—3 in FIG. 2.

The portable basket 50 has a bottom panel 55 with an upstanding peripheral wall 56 and with the bottom panel 55 having a series of openings 57 symmetrically-related to a central, vertical axis of the dryer. One of these openings 57 is shown in plan in FIG. 2, in the upper left corner of the basket and without holder 51 and thimble 52 associated therewith. The opening permits access from beneath the portable basket to the silverware holder for a purpose to be described. A strap 58 spans the opening and is suitably secured at its end, as by attaching means 59, to the bottom panel 55 of the basket. A pin 60 extends upwardly from the strap 58 intermediate the ends thereof.

The silverware holder 51 has a base 61 with a central opening 62 to enable placement of the holder on the pin 60. A silverware-holding section 64 of the holder 51 is spaced from the base and connected thereto by vibratory means, in the form of a loosely-coiled spiral spring 65 having a lower end secured to the upper side of the base 61 and continuing into the holding section and there having upper convolutions of increasing diameter. A series of angled plates 66 are connected to said upper convolutions to rigidify the structure and with there being four of said plates equally spaced around the perimeter of the silverware-holding section. The underside of the base 61 has a series of downwardly-projecting teeth 70 for a purpose to be described.

The thimble 52 is formed as a generally cylindrical container 75 having an open top and an open bottom 76. The wall of the container is perforate to permit free flow of water therethrough. The thimble container 75 has a height approximately equal to the height of the uniform diameter section of the loosely-coiled spring 65 of the holder 51. A perforate-walled, movable cup 80 is movably mounted within the thimble container 75 and, as shown in FIG. 4, the lower ends of the silverware rest on this cup. The movable cup 80 rests on a flange 77 and, as subsequently described, the movable cup can be raised relative to the thimble container to facilitate outward flaring of the silverware during drying thereof. A transverse partition 81 limits the inclination of the silverware.

Figure 6:
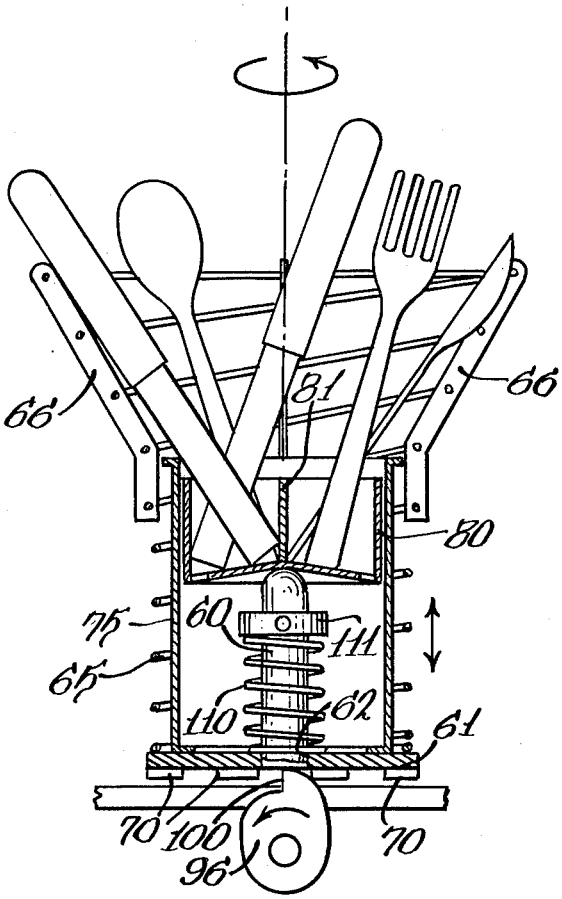
FIG. 6 is a sectional view, taken generally along the line 6—6 in FIG. 3 and showing the thimble of FIG. 4 mounted in a holder, as shown in FIG. 5.

The portable basket 50, silverware holder 51, and thimble 52 are utilized during washing of the silverware as well as in the dryer disclosed herein. Preparatory to washing, silverware is loaded into the thimble 52, as shown in FIG. 4. With there being four of the silverware holders 51 mounted on the four pins 60 of the portable basket, it is possible to use four of the thimbles 52. Each thimble is moved downwardly into position within the silverware holder to the position shown in FIG. 6 and during this movement the associated pin 60 engages the underside of the movable cup 80 and moves it upwardly relative to the thimble container 75. This results in an outward inclination and spreading of the silverware, as shown in FIG. 6. The portable basket can then be associated with suitable washing apparatus for washing of the silverware. The spiral spring 65 constitutes flexible means which enables the holding section 64 and silverware contained therein to sway and jostle in response to the weight and pressure of water in the wash cycle which minimizes shadowing.

At the completion of the washing cycle, the portable basket is associated with the dryer shown in FIG. 1, with the cover being pivoted to an open position and after placement of the basket to the position shown in FIG. 1, the cover is closed preparatory to operation. The portable basket is located and held in position within the dryer by a series of relatively short angle irons 85 secured to the upper side of platform 20. When ready for operation, the blower 30 is started and also the drive motor 45. Operation of the blower causes high velocity air to blow downwardly on the silverware from the four downwardly-directed nozzles, two of which are shown at 37 and 38, and also air to flow inwardly from the sides of the drying chamber through the ducts 40 and 41.

The drying action is improved by causing rotation and agitation of the silverware holders. This action is caused by means including the drive motor 45 which drives an upwardly-extending shaft 88 which extends upwardly through a fixed mounting plate 89 and centrally through a fixed bevel gear 90. A transverse member 91 is connected to the upper end of the shaft 88 and has reduced diameter extensions 92 and 93 extending from opposite ends thereof. Each of the extensions rotatably mounts a sleeve member 94 and 95, respectively. Each of these sleeve members carries a cam 96 and 97, respectively, which are caused to rotate in the same direction by a pair of gears associated, one with each sleeve, and identified at 98 and 99, respectively. The motor 45, through suitable gear reduction, drives the shaft 88 at a suitable speed to bodily rotate the cams around the vertical, central axis of the dryer defined by the shaft 88 and with the rotation of the gears 98 and 99 on the bevel gear 90 also causing rotation of the cams whereby a cam, such as cam 96 shown in FIG. 6, engages the base 61 of the holder to cause elevation thereof. The cam has a notch 100 to engage a tooth 70 extending downwardly from the base whereby a holder is cyclically moved up and down and rotated. The cam contour permits a downward snap action to the holder whereby vibration is imparted thereto. This is effected by a spring 110 surrounding a pin 60 and captured between a ring 111 fastened to the pin and the upper side of a holder base 61. The thimble 52 loosely fits within the holder whereby the loosely-coiled, flexible spring 65 enables this vibration to be transmitted to the holder section 64 to impart vibratory shift to the silverware within the holder. This action results in good exposure of all surfaces of the silverware to the drying air for complete drying of the silverware without water spots.

With the structure disclosed herein, it will be seen that the silverware need only be loaded once for both washing and drying and with the structure simply positioning the silverware for good drying and changing the exposure thereof to the drying air during the drying cycle.

We claim:

1. A silverware dryer comprising, a casing having means for directing air to a drying chamber, a portable basket positionable in said drying chamber, a vibratory holder for silverware mounted on said basket for rotational and up and down movement, flexible means mounting said holder to said basket for relatively free vibration, and motor-driven means for rotating and vibrating said holder with a snap action.

2. A silverware dryer as defined in claim 1 wherein said basket has a plurality of said holders with each having a series of spaced teeth and said motor-driven means includes at least one rotatable cam which is bodily rotated to a position to engage one of said teeth and together with cam rotation causes rotation as well as up and down movement of a holder.

3. A silverware dryer as defined in claim 1 wherein said holder has a base and an outwardly sloped silverware-retaining section spaced therefrom, and said flexible means being a loosely coiled spiral spring whereby said section can freely vibrate as caused by said motor-driven means.

4. A silverware dryer as defined in claim 3 including a perforated thimble for carrying silverware to be placed in said holder, said thimble having a bottom with a central opening and a movable cup therein, an upstanding pin secured to said basket and extending through an opening of said base and of a size to enter said central opening and raise said movable cup as a thimble is placed in said holder.

5. A silverware dryer as defined in claim 1 wherein there are a plurality of holders mounted on said basket and said means for directing air comprises a air nozzle overlying each of said holders and additional nozzles at the side of said holders, said casing having a pivotal cover overlying said drying chamber and said overlying air nozzles being mounted on said cover whereby said cover may be pivoted to an open position to permit placement of a basket in said drying chamber.

6. A vibratory holder and thimble combination for holding silverware for washing or drying thereof, said holder comprising, a base movably-mounted on a pin extending upwardly therethrough, a silverware-retaining section spaced from said base and shaped to retain silverware in an outwardly-in-clined position, and flexible spring means connecting said section to said base, said thimble comprising an open top cylindrical member with a perforate side wall and a bottom with a central opening and of a height approximating that of said flexible means, a movable cup in said thimble which supports the lower ends of the silverware whereby placement of a thimble downwardly into said holder causes said pin to enter said central opening and lift said movable cup to move said silverware upwardly in the thimble and into said outwardly-inclined position in said retaining section of the holder.

7. A combination as defined in claim 6 wherein said flexible means comprises a loosely-coiled spiral spring.

8. A combination as defined in claim 6 wherein said silverware-retaining section is formed as a loosely-coiled spiral spring of upwardly-increasing internal diameter, and spaced rigidifying means connected thereto.

9. A silverware dryer having a vibratory holder and thimble combination for holding silverware to be dried, said holder comprising, a base, a silverware-retaining section spaced from said base and shaped to retain silverware in an outwardly-inclined position, a loosely-coiled spiral spring connecting said section to said base, said thimble comprising an open top cylindrical member of a height approximating that of said flexible means, a movable cup in said thimble which supports the lower ends of the silverware, and means responsive to movement of a thimble downwardly into said holder causing said movable cup to move said silverware upwardly in the thimble and into said outwardly-inclined position in said retaining section of the holder.

10. A silverware dryer having a vibratory holder and thimble combination for holding silverware to be dried, said holder comprising, a base, a silverware-retaining section spaced from said base and shaped to retain silverware in an outwardly-inclined position, and vibratable means connecting said section to said base, said thimble comprising an open top cylindrical member with a perforate side wall of a height approximating that of said flexible means, and a movable cup in said thimble which supports the lower ends of the silverware and which can be raised to move said silverware upwardly in the thimble and into said outwardly-inclined position in said retaining section of the holder.

11. A dryer for utensils such as silverware and the like comprising: a casing having a drying chamber; a portable basket positionable in said chamber and having a plurality of holders uniformly spaced from a central vertical axis of said dryer; each of said holders having an upstanding pin fixed to a bottom of said basket, a base movably mounted on said pin with spaced teeth on the underside thereof which are exposed through an opening in the bottom of the basket, spring means urging said bases toward the basket, and a utensil-retaining section spaced upwardly from said base with flexible wire connecting means therebetween; a thimble positionable in a holder with means engageable by said pin for moving utensils upwardly relatively to said thimble; and means for cyclically rotating and vibrating said holders comprising, a drive shaft extended along said central vertical axis, a transverse member mounted at the upper end of said drive shaft, a pair of rotatable toothed cams mounted independently of each other at opposite ends of said transverse member and movable into association with teeth of two of said holders as said drive shaft rotates, said cams having contours to lift said bases away from the baskets and thereafter permit a snap action return of the bases as caused by said spring means.

12. A dryer for utensils such as silverware and the like comprising: a casing having a drying chamber; a portable basket positionable in said chamber and having a plurality of holders uniformly spaced from a central vertical axis of said dryer; each of said holders having an upstanding pin fixed to a bottom of said basket, and a base movably mounted on said pin with spaced teeth on the underside thereof which are exposed through an opening in the bottom of the basket; a thimble positionable in a holder with means engageable by said pin for moving utensils upwardly relatively to said thimble; and means for cyclically rotating and vibrating said holders comprising, a drive shaft extended along said central vertical axis, a transverse member mounted at the upper end of said drive shaft, a pair of rotatable toothed cams mounted independently of each other at opposite ends of said transverse member, and means for rotating said cams at the same time as they are bodily rotated about said central axis to cyclically move into engagement with a tooth on a holder base.

13. A dryer for utensils such as silverware and the like comprising: a casing having a drying chamber with a pivoted cover overlying said chamber; a portable basket positionable in said chamber and having a plurality of holders uniformly spaced from a central vertical axis of said dryer; each of said holders having an upstanding pin fixed to a bottom of said basket, a base movably mounted on said pin with spaced teeth on the underside thereof which are exposed through an opening in the bottom of the basket, and a utensil-retaining section spaced upwardly from said base with flexible wire connecting means therebetween; a thimble positionable in a holder with means engageable by said pin for moving utensils upwardly relatively to said thimble; blower means for directing air against utensils in said chamber including downwardly-directed nozzles mounted on said cover for movement therewith; and means for cyclically rotating and vibrating said holders comprising, a drive shaft extended along said central vertical axis, a transverse member mounted at the upper end of said drive shaft, a pair of rotatable cams mounted independently of each other at opposite ends of said transverse member, a fixed gear surrounding said drive shaft, a pair of gears engaging said fixed gear and associated one with each of said rotatable cams whereby said cams rotate at the same time as they are bodily rotated about said central axis to cyclically move into engagement with a tooth on a holder base and raise said holder, and said cams each having a notch to positively engage a tooth.

14. A vibratory holder for holding silverware for washing and drying thereof comprising, a base, a silverware-retaining section spaced from said base and shaped to retain silverware in an outwardly-inclined position, and a spring connecting said section to said base whereby said holder can sway and jostle in response to impingement of water thereon as well as in response to mechanical agitation.

15. A holder as defined in claim 14 wherein said spring comprises a loosely-coiled spiral spring.

16. A holder as defined in claim 15 wherein said silverware-retaining section is formed as a loosely-coiled spiral spring of upwardly-increasing internal diameter and spaced rigidifying means connected thereto.

* * * * *